United States Patent [19]

Kramer

[11] Patent Number: 4,540,263

[45] Date of Patent: Sep. 10, 1985

[54] FILM PROCESSOR HAVING A LOADING DOOR INTERLOCK

[75] Inventor: G. Richard Kramer, Arlington, Mass.

[73] Assignee: Polaroid Corporation, Cambridge, Mass.

[21] Appl. No.: 619,602

[22] Filed: Jun. 11, 1984

[51] Int. Cl.[3] ..... G03D 5/02; G03D 5/06

[52] U.S. Cl. ..... 354/304; 354/313; 354/318

[58] Field of Search ..... 354/301, 303, 304, 318, 354/313

[56] References Cited

U.S. PATENT DOCUMENTS

| | | | |
|---|---|---|---|
| 4,309,100 | 1/1982 | Bendoni et al. | 354/318 |
| 4,370,045 | 1/1983 | Holmes | 354/318 |
| 4,371,248 | 2/1983 | Sulesky | 354/318 |
| 4,371,249 | 2/1983 | Crumak et al. | 354/318 |
| 4,417,799 | 11/1983 | Mills | 354/304 |
| 4,445,770 | 5/1984 | Morse | 354/303 |

*Primary Examiner*—A. A. Mathews

*Attorney, Agent, or Firm*—Alfred E. Corrigan

[57] ABSTRACT

Film processor having a lighttight chamber defined in part by a door, a station at which a processing kit containing therein a rupturable container of processing liquid may be located, a rack movable from a first position toward a second position during which it opens the kit and also latches the door in a closed position, and a manually operable lever for moving the rack between said positions. Movement of the lever toward a processing position is transmitted to the rack and to a processing container rupturing member so as to cause the rack to open the processing kit prior to movement of the rupturing member into rupturable engagement with the container as the rack moves into the second position. Also, during such movement of the rack, the door is latched in the closed position, thus preserving the lighttightness of the chamber during processing of a length of film. The processor is provided with an interlock which prevents the door from being moved into a fully closed position when the rack is already in the second position thus preventing an improper sequence of events by the rack and thus possible damage to the lever. Also prevented is accidental latching of the door in the closed position.

10 Claims, 10 Drawing Figures

FILM PROCESSOR HAVING A LOADING DOOR INTERLOCK

BACKGROUND OF THE INVENTION

1. Field of the Invention

This invention relates to a manually operable apparatus for processing individual rolls of photographically exposed film.

2. Description of the Prior Art

The present invention relates to a manually operable, compact, portable processor which is adapted to be used in the processing of individual rolls of photographic film, preferably of the 35 mm self-developing or instant type transparency film and, more particularly, to such a processor which includes an interlock for insuring the proper sequence of events during a processing cycle.

Often, apparatus of the type described have a processing cycle wherein events must be carried out in a predetermined sequence. For example, in a processor of the type described and shown in U.S. Pat. No. 4,445,770, a rack is mounted for linear movement between a first position, wherein the processor's loading door may be opened, to a second position. As the rack is moved toward the second position, by virtue of the manual rotation of a lever, it opens a processing kit and locks the cover or loading door in its closed position thereby rendering the housing lighttight during the processing of a roll of film. However, if the rack were initially located in the second position at the time that the processing kit was inserted into the processor, an arm of the rack would not be located correctly relative to a movable housing section of the processing kit. Thus, it is possible that when the loading door is moved into its closed position, a lip on the loading door may be cammed outwardly by an arm and thence sprung inwardly under a latching surface thereby locking the loading door in the closed position. Note, although the arm extends outwardly into the path of movement of the door because the rack is in the second position, it, the arm does not prevent the door from being closed. Next, counterclockwise rotation of the lever by the operator into a vertical position will result in the connection between the lever and a sector gear being broken, generally without the operator's knowledge. The operator then will rotate a crank to thereby withdraw the exposed film from its film cassette and a length of sheet material from the kit while simultaneously winding them in superposition upon a take-up roller. Ordinarily, the sheet material would have a coating of processing liquid thereon but, since the lever connection with the sector gear was broken, the lever was never able to move a rupturing member into rupturable engagement with a container of processing liquid located within the processing kit. Even if it could move the rupturing member, the processing kit is still closed and thus more breakage would possibly occur. The final steps in the processing cycle are then attempted by the operator, i.e., (1) the lever is returned to its original position after a sixty second wait for the film to be developed (which has not been done), (2) the crank is again rotated in an attempt to rewind the film and sheet material into their original containers (which does not happen because movement of the lever in step 1 failed to return the rack to the first position), and (3) an attempt is made to open the loading door (which is still latched in the closed position). Finally, when the operator is able to pry the loading door open, thus possibly causing more damage to the processor, the exposed film (which is still on the take-up roller) is then fogged by the ambient light because it is still in an undeveloped condition. Accordingly, it can readily be appreciated that there is a need to construct such a film processor in a way which will insure that the different steps in the processing cycle are carried out in a predetermined sequence. One way of accomplishing such a construction may be by way of an interlock, as was done in U.S. Pat. No. 4,417,799.

SUMMARY OF THE INVENTION

The present invention relates to a compact, portable apparatus in the form of a film processor which is specifically constructed for use in the processing of individual rolls of instant or self-developing film, preferably of the type enclosed in a film cassette of a design readily receivable by conventional 35 mm cameras, and more particularly to such a film processor having means for insuring a proper sequence of operating events. The apparatus includes a lighttight housing having a loading door which is pivotally mounted for movement between open and closed positions. The housing is constructed to receive a disposable film processing kit which contains a housing comprised of two sections, one of which is movable between open and closed positions, a roller having a length of flexible sheet material wound thereupon, a container of processing liquid, and a dispenser. The apparatus also includes structure for supporting a film cassette containing a roll of exposed film, and a spool or take-up roller which is adapted to receive the leaders of the sheet material and the film so as to wind the two in superposition upon the take-up roller, as will be further explained later. The take-up roller or spool includes first and second posts to which the leaders are attached via apertures in their free ends. The structural relationship between the posts and apertures is such that the leader of the sheet material will automatically detach itself from the first post when a laminate comprised of the sheet material and film is completely unwound from the take-up roller, while the second post maintains its connection with the film leader.

Mounted along one side of the housing of the apparatus is a gearbox containing a power transmission system including a plurality of gears, clutches and drives. One of the drives is adapted to drive the take-up roller during a processing operation while simultaneously drives to the film's spool and the sheet material's roller are disconnected. Conversely, the latter two drives are adapted to power the film spool and sheet material roller during a subsequent processing operation while the drive to the take-up roller is disconnected.

The apparatus further includes a rack mounted for movement between first and second positions and second gear arrangement which incorporates a lost motion feature. After the film cassette and film processing kit have been loaded into the apparatus and the leaders of the film and sheet material have been attached to the take-up roller, the loading door is closed thereby rendering the apparatus lighttight. A manually operable lever is then rotated through an angle of approximately ninety-five degrees into a processing position. During the first part of such rotation, a sector gear connected to the lever drives the rack in a rearward direction relative to the take-up roller toward its second position. The rack includes an inwardly extending arm which was previously located within a recess in one of the two sections of the kit housing during loading of the kit into the processor. As the rack moves rearwardly, its arm moves the one section in a corresponding direction thereby opening the housing and exposing the container of processing liquid. Continued rotation of the lever results in a roller being pivoted into the ever increasing opening caused by the rearward movement of the one housing section of the kit. The roller is pivoted into engagement with the container and ruptures it thereby allowing the processing liquid to flow into the dispenser. Simultaneously with the rearward movement of the rack, the loading door is automatically locked in its closed position and the power transmission system is automatically manipulated such that any subsequent power input by a manually operable crank is directed to the take-up roller. Rotation of the crank drives the take-up roller in a direction which simultaneously unwinds the sheet material from its roller and the film from its spool. As the sheet material is unwound from its spool, it passes beneath the dispenser where a coating of the processing liquid is applied to a gelatin coated surface of the sheet material. That coated surface is then moved into engagement with the emulsion side of the exposed film and the two are directed between a pair of pressure applying rollers to form a laminate which is subsequently wound upon the take-up roller. The laminate remains wrapped upon the take-up roller for a period of time sufficient to form visible images in the laminate, preferably in the film.

After the above-mentioned period of time has elapsed, the operator rotates the lever in an opposite direction so as to return it to its original position. Such rotation not only moves the roller out of the kit, but it also moves the rack forwardly into its original or first position. The forward movement of the rack results in its arm moving the one housing section into closing relation with the other housing section as the roller moves out of the kit. Simultaneously therewith the rack moves the lock out of latching engagement with the loading door and manipulates the power transmission system such that any subsequent power input by the crank is delivered to the sheet material roller and the film spool rather than to the take-up roller. The crank is then rotated in the same direction as during the previous processing operation. Such rotation is effective to drive the sheet material roller and the film spool in directions which withdraw or unwind the laminate from the take-up roller while simultaneously stripping the film from the sheet material as the film and the sheet material are rewound upon the spool and roller, respectively. As the last convolution of the laminate is unwound from the take-up roller, the first post automatically releases the leader of the sheet material so that it may be returned completely to its kit while the second post maintains the attachment of the film leader to the take-up roller. After the sheet material has been returned to its kit, the loading door of the processor may then be opened, the kit containing the used sheet material and any remainding residue of the processing operation removed and safely discarded, the film leader detached from the second post, and the film cassette removed from the processor. The processed film may then be removed from its cassette, and the individual scenes in the processed film cut and mounted in frames for subsequent viewing.

The apparatus further includes an interlock to insure that the rack is in its first position prior to moving the loading door into its closed position, thereby insuring the proper sequence of events during a processing cycle. The interlock includes a portion of the rack and a pin located on an interior surface of the loading door. The spacial relation between the two is such that when the rack is in the second position prior to movement of the loading door toward its closed position, the pin strikes the portion of the rack thereby preventing further movement of the loading door into its closed position. It is only when the rack is in the first position that the loading door may be fully closed. Also, in the latter case, movement of the rack into its second position results in the interlock functioning as a preferred means for latching the loading door in its closed position.

An object of the invention is to provide a compact, portable film processor with means for preventing operation thereof when at least one element thereof is not properly positioned.

Another object of the invention is to provide a film processor with a loading door which cannot be accidentally latched in a closed position.

Other objects of the invention will in part be obvious and will in part appear hereinafter.

The invention accordingly comprises the apparatus possessing the construction, combination of elements and arrangement of parts which are exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description taken in connection with the accompanying drawings wherein.

DETAILED DESCRIPTION OF THE INVENTION

Figure 1:
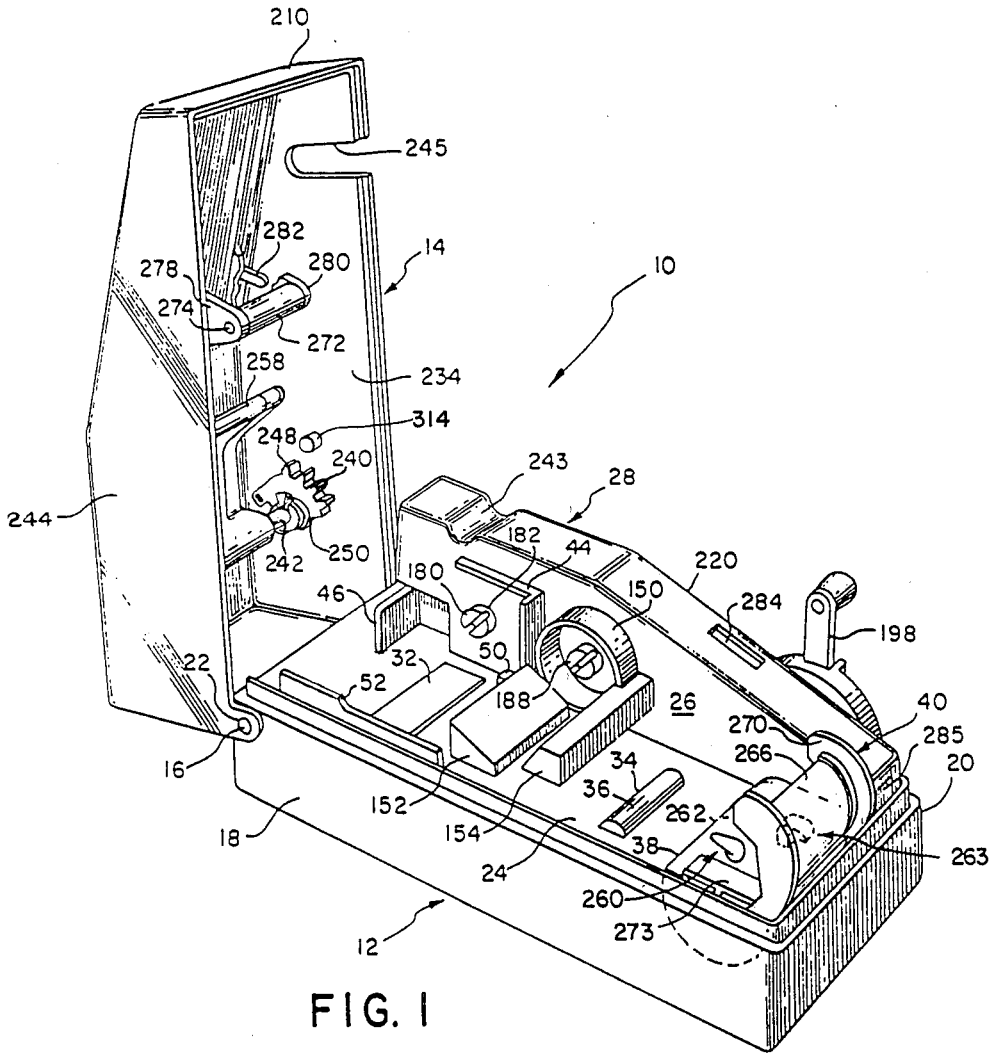
FIG. 1 is a perspective view of a preferred form of apparatus for use in processing a length of exposed film.
Figure 2:
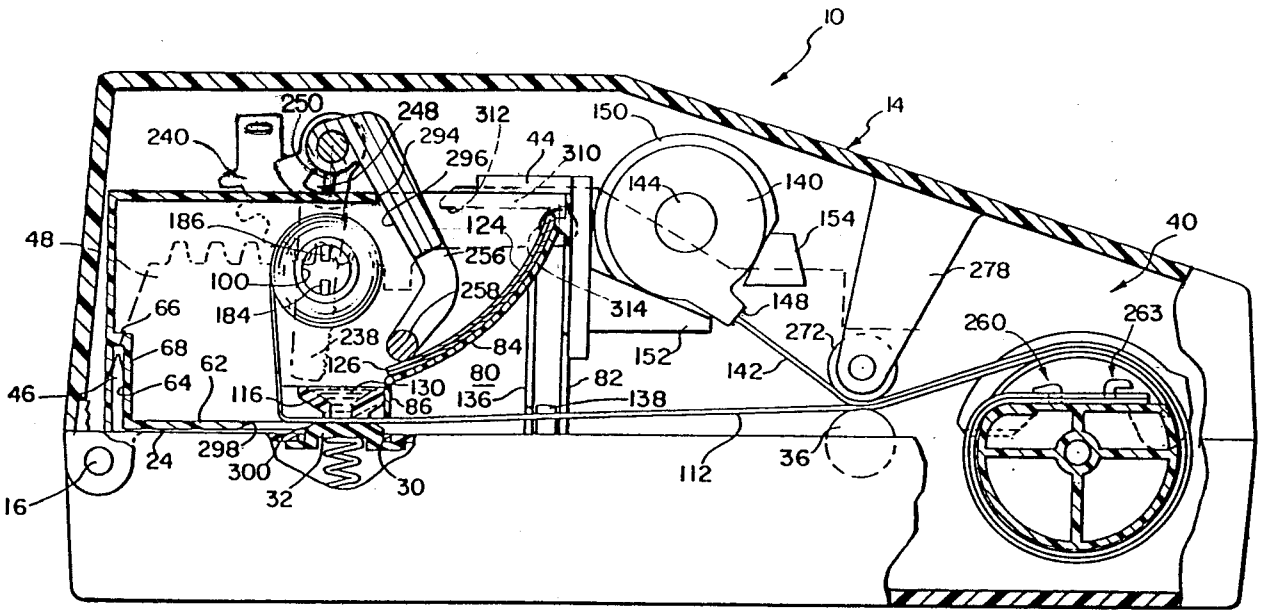
FIG. 2 is a side elevational view of the apparatus of FIG. 1, the apparatus being shown with its loading door in a closed position and a processing kit in an open condition, certain parts being omitted or sectioned for reasons of clarity.

Reference is now made to the drawings and, in particular, to FIGS. 1 and 2 wherein is shown a preferred form of an apparatus 10 for processing a roll of exposed film, the film preferably being of the 35 mm instant or self-developing type transparency film. The apparatus 10 includes a housing 12 having a loading door 14 pivotally coupled at one end thereof by a pair of pins 16 (only one being shown) which extend outwardly from opposite side walls 18 and 20 of the housing 12 and are received by apertures 22 (only one being shown) in the loading door 14. Movement of the loading door 14 into its closed position (see FIG. 2) renders the housing 12 lighttight.

A generally horizontal support 24 extends between the side wall 18 and a side wall 26 of a gearbox 28. The support includes a first opening 30 through which a spring-biased plate 32 is adapted to extend, a second opening 34 through which a portion of a roller 36 is adapted to extend, and a third opening 38 through which a portion of a take-up roller or spool 40 is adapted to extend. Both the roller 36 and the take-up roller 40 are suitably mounted for rotation about their respective axes by means not shown.

The apparatus 10 also includes means for locating a film processing kit 42 in its proper position relative to other elements of the apparatus 10. Generally, these means include an L-shaped flange 44 which extends inwardly from the side wall 26 of the gearbox 28, an arm 46 which extends at a right angle to a rack 48 (see FIG. 4), a pair of cams 50 (only one being shown) which are located adjacent opposite sides of the horizontal support 24, and a plate 52 which extends along the side wall 18.

Figure 6A:
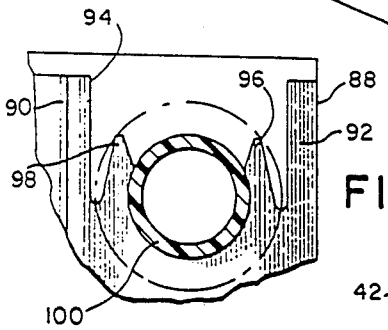
FIG. 6A is a side elevational view of a portion of the film processing kit.
Figure 6:
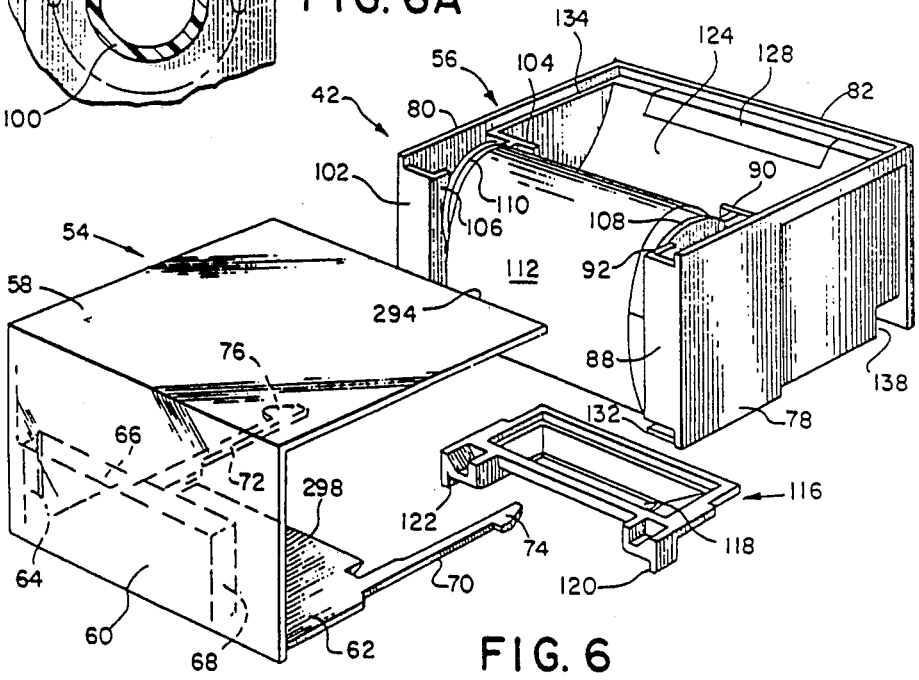
FIG. 6 is a partly exploded perspective view of a disposable film processing kit which is especially adapted for use with the apparatus shown in FIG. 1.

The film processing kit 42, as best shown in FIG. 6, includes a housing consisting of a first section 54 and a second section 56 which is constructed to telescopically receive the first section 54. The first section includes a top wall 58, an end wall 60, and a bottom wall 62. The end wall 60, as best seen in FIG. 2, includes a passageway 64 formed by a generally horizontal flange 66 and a vertical flange 68 for receiving the arm 46 of the rack 48. The bottom wall 62, which has a length slightly less than one-half that of the top wall 58, includes a laterally spaced pair of fingers 70 and 72 whose ends are provided with tapered latching members 74 and 76, respectively.

The second section 56 includes a pair of side walls 78 and 80 interconnected at one end by an end wall 82. A gently curving wall 84 extends between the side walls 78 and 80 and slopes downwardly from the top of the end wall 82 to a point where it terminates in a generally vertical wall 86. A pair of flanges 88 and 90 extend inwardly from the side wall 78 to a point where they are interconnected by a wall 92 (see FIG. 6A). The wall 92 has a U-shaped opening 94 therein. A pair of resilient fingers 96 and 98, which are integral with the wall 92, extend into the U-shaped opening. As best seen in FIG. 6A, the resilient fingers 96 and 98 are adapted to be moved away from each other as the end of a roller 100 is moved downwardly into the U-shaped opening 94 and then return to the position shown to thereby provide a drag on the end of the roller 100. A pair of flanges 102 and 104 extend inwardly from the side wall 80 to a point where they are interconnected by a wall 106 having U-shaped opening (not shown) therein for rotatably receiving the opposite end of the roller 100. The roller 100 has a pair of annular flanges 108 and 110 which are adapted to be positioned between the walls 92 and 106. A length of sheet material 112, e.g. a polyester film such as Mylar having a gelatin coating on one side, is coiled about the roller 100 with a trailing end secured to the roller 100 and a leading end or leader 114 which is adapted to be releasably attached to an exterior surface of the end wall 82. An opening (not shown) is located in wall 80 in alignment with the end of the roller 100 so as to enable a drive member to protrude therethrough and drivingly engage the roller 100, as will be further explained later.

Also mounted in the second section 56 is a processing liquid dispenser 116. The dispenser includes a nozzle 118 and a pair of laterally spaced flanges 120 and 122 which function to restrain sidewise movement of the sheet material 112 as it passes beneath the nozzle 118. The nozzle has a length which is less than the width of the sheet material 112 and is approximately equal to the distance between laterally spaced sprocket holes in a strip of 35 mm film, i.e., two and one-half centimeters.

A container 124 having a rupturable end 126, see FIG. 2, is supported on the wall 84 by any suitable means, e.g., by a strip of adhesive tape 128. The container 124 holds a supply of viscous processing liquid 130, the quantity of which is sufficient to coat substantially the entire length of the sheet material 112.

A flange 132 extends inwardly from the bottom of the side wall 78. The flange 132 cooperates with a similar flange (not shown) which extends inwardly from the side wall 80 to guide the lateral edges of the bottom wall 62 as the second section 56 telescopically receives the first section 54 during closing of the kit 42. A recessed area 134 extends around portions of the side walls 78 and 80 and the end wall 82 and cooperates with the tops of the flanges 88, 90, 102 and 104 to receive the edges of the top wall 58. As the edge of the top wall 58 moves into engagement with the end wall 82, the latching members 74 and 76 are first cammed inwardly toward each other by a pair of flanges 136 (only one being shown) which extend inwardly from the side walls 78 and 80. The members 74 and 76 then spring outwardly to grab the right side, as viewed in FIG. 2, of the flanges 136 thereby locking the two sections 54 and 56 in the closed position, with the bottom wall 62 holding the sheet material 112 in sealing relation to the nozzle 118. The latching members 74 and 76 are adapted to be moved out of latching engagement with the flanges 136 by the cams 50 in the apparatus 10 as the kit is being loaded in the apparatus. During such loading, the cams 50 enter a pair of apertures 138 (only one being shown) located in the side walls 78 and 80 and force the latching members 74 and 76 inwardly toward each.

The apparatus 10 further includes means for supporting a film cassette 140 containing a roll of exposed, self-developing type transparency film 142, the film being wound upon a rotatable film spool 144 with one end of the film being secured to the film spool 144 and its opposite end or leader 146 being adapted to extend to the exterior of the film cassette via a film withdrawal slot 148. These means include a semi-annular flange 150, which is adapted to receive one end of the generally cylindrical film cassette 140, and a pair of supports 152 and 154.

Figure 5:
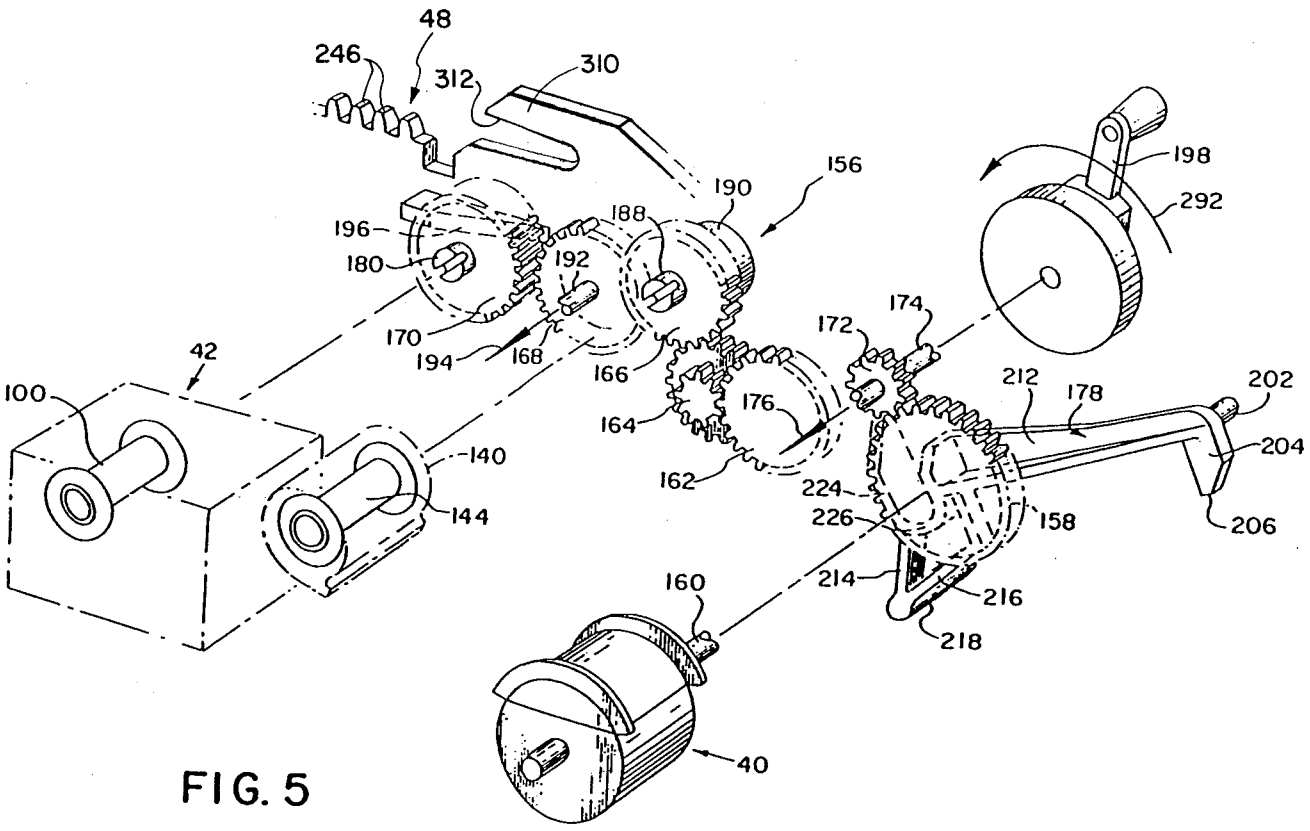
FIG. 5 is a schematic representation of the apparatus' power transmission system and its relation to various other elements which are part of or usable with the instant invention.

A power transmission means 156 is mounted within the gearbox 28. As shown in FIG. 5, the power transmission means 156 includes a first power path consisting of a gear 158 which is fixedly attached to a shaft 160 which, in turn, is fixedly attached to the take-up roller 40, a second power path consisting of gears 162, 164 (compound), 166, 168 and 170, and an element, i.e., a gear 172. The gear 172 is mounted on a shaft 174 for limited axial movement between a first position wherein it is solely in drivable engagement with the second power path and a second position (shown in FIG. 5) wherein it is solely in drivable engagement with the first power path. The gear 172 is normally biased into engagement with the gear 158 and is adapted to be moved in the direction of the arrow 176 into engagement with the gear 162 by a bell crank 178, as will be further explained shortly. A slotted drive member 180 extends from the face of the gear 170 and protrudes through an opening 182 in the wall 26 of the gearbox 28 where it is adapted to drivingly engage a pair of tabs 184 and 186 (see FIG. 2) which are integrally formed with the roller 100. A similar drive member 188 extends from the face of the gear 166 and protrudes through an aperture in the side wall 26 where it is adapted to be located in driving engagement with the end of the film spool 144. A clutch 190 is coupled between the gear 166 and its drive member 188 to allow slippage therebetween during the time that the roller 100 and film spool 144 are being driven, thereby compensating for any differences in the increasing diameters of the roll of sheet material 112 and the film 142. It will also be noted that the gear 168 is mounted for limited linear movement along its shaft 192. The gear is normally biased out of engagement with the gear 166 when the take-up roller 40 is being driven and is adapted to be moved in the direction of the arrow 194 into driving engagement with the gear 166 by a cam 196 located on the side of the rack 48, as will be more fully explained hereinafter. The power input to the power transmission means 156 includes a manually operable hand crank 198 which is fixedly attached to the shaft 174 at a point where the shaft 174 protrudes through the side wall 20 of the apparatus 10.

Figure 3:
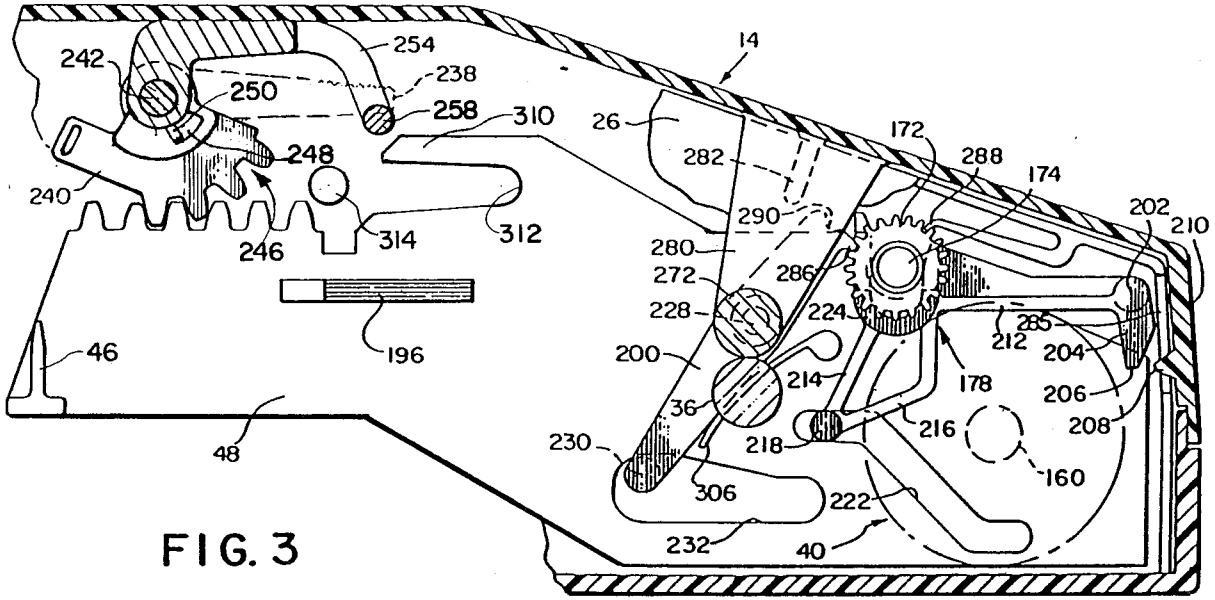
FIG. 3 is an enlarged side elevational view, partly in section, of a portion of the apparatus of FIG. 1.
Figure 4:
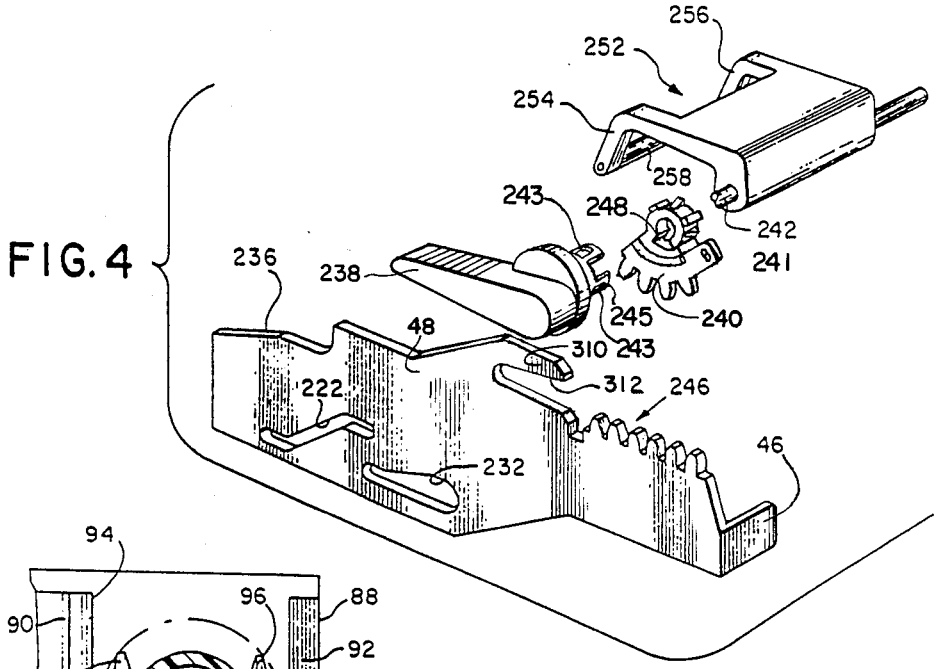
FIG. 4 is an exploded perspective view of a lost motion system.

Reference is now made to FIG. 3 wherein the operation of the bell crank 178 will be more fully described. In this view, the take-up roller 40 is shown in phantom lines so as to faciltate an understanding of the movement of the bell crank 178. Further, although the bell crank 178 and a juxtaposed link 200 are located within the gearbox 28, the power transmission system 156, except for gear 172, has been omitted for reasons of clarity. The bell crank 178 and the link 200 are adapted to interrelate with the rack 48 to provide a pluality of functions. Specifically, the bell crank 178 is pivotally coupled to a wall of the gearbox 28 by a pin 202 which extends outwardly from the bell crank 178. One arm 204 of the bell crank 178 includes a latching surface 206 which is adapted to be moved into engagement with a lip 208 formed on the interior surface of an end wall 210 of the loading door 14 so as to lock it in the closed position. The other arm 212 of the bell crank 178 includes a pair of downwardly converging legs 214 and 216 which are joined at their end by a cam follower 218 which extends at a right angle to a plane containing the legs 214 and 216. The cam follower 218 extends through an arcuate slot (not shown) in a side wall 220 to a point where its end terminates in a cam slot 222 in the rack 48. The upper left-hand end of the arm 212 includes a U-shaped portion 224 having inclined camming surfaces 226 (see FIG. 5). The U-shaped portion 224 is constructed to move the gear 172, against its spring bias, from engagement with the gear 158 and into engagement with the gear 162 when the bell crank 178 is rotated in a clockwise direction about its pivot pin 202. The link 200 is pivotally connected intermediate its ends by a pin 228 which extends between the side walls 26 and 220 of the gearbox 28. One end of the link 200 includes a cam follower 230 which extends at a right angle thereto. The cam follower 230 protrudes through another arcuate slot (not shown) in the side wall 220 and terminates at a location within a second cam slot 232 in the rack 48. The rack 48 is supported by means (not shown) at a location between the side wall 220 and a side wall 234 of the loading door 14. As best seen in FIG. 4, one end of the rack 48 is cut away at 236 to provide clearance for the shaft 74 of the crank 198 when the rack 48 is reciprocated into the position shown in FIG. 3.

The rack 48 is adapted to be reciprocated from a first position, as shown in FIG. 3, to a second position, as shown in FIGS. 2 and 5. The mechanism for reciprocating the rack 48 includes a manually operable lever 238 (see FIG. 4) which is fixedly coupled to a sector gear 240 via a plurality of lugs 241 which are adapted to be received by apertures 243 in a hollow cylindrical portion 245 of the lever 238. The lever 238 and sector gear 240 are freely rotatable on a shaft 242 which has its opposite ends journaled in the side walls 234 and 244 of the loading door 14. The teeth of the sector gear 240 are adapted to drivingly engage a set of teeth 246 located in the top edge of the rack 48 when the loading door 14 is in the closed position. The sector gear 240 includes an aperture 248 which is adapted to receive a pin 250 (see FIG. 3) which extends radially outward from the shaft 242 to define a lost motion connection between the lever 238 and a processing fluid container rupturing mechanism 252. The mechanism 252, which is integrally formed with the shaft 242, includes a pair of arms 254 and 256 which rotatably support a roller 258 therebetween.

Figure 7:
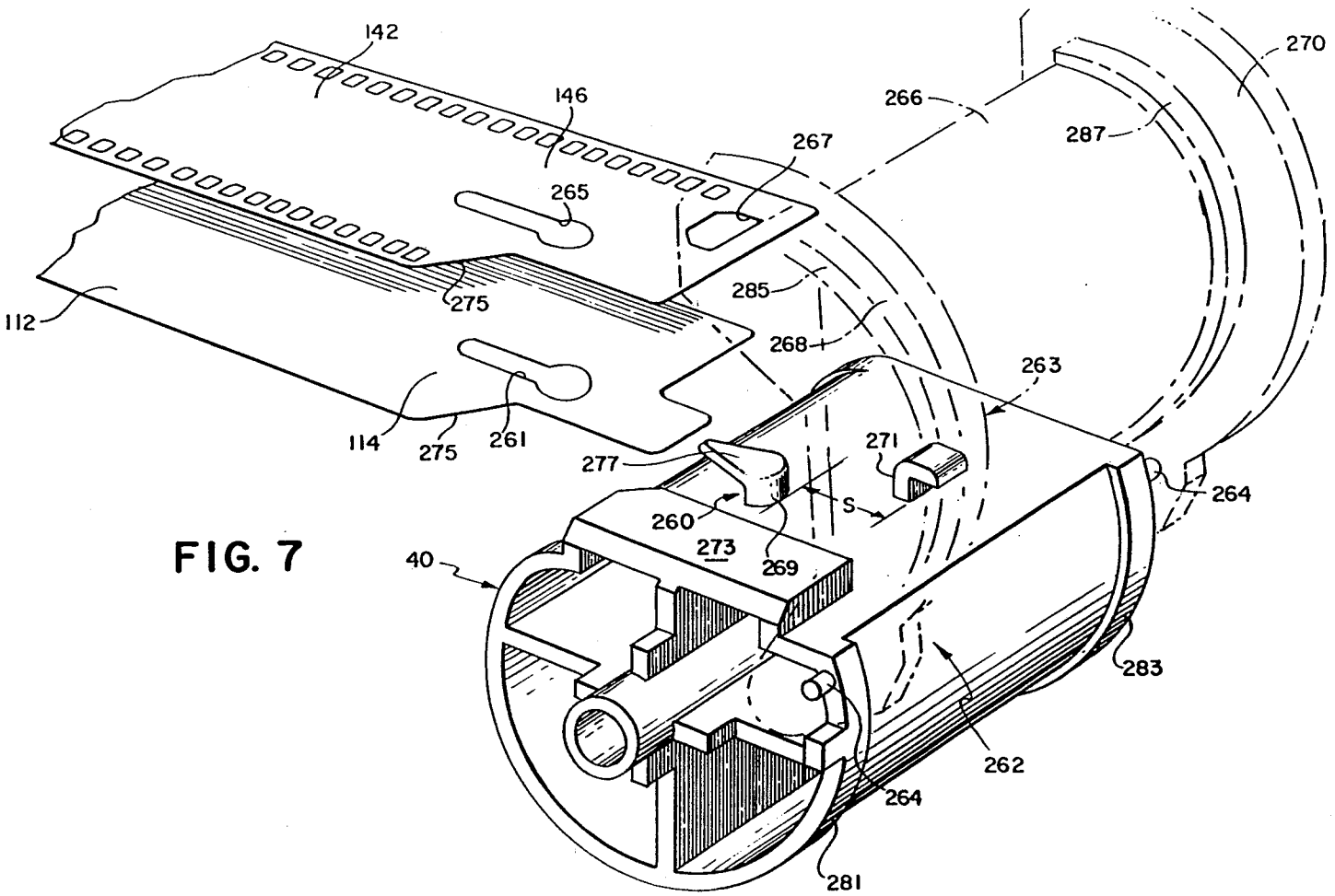
FIG. 7 is an enlarged perspective view of the apparatus' take-up roller or spool and its relationship to a pair of leaders having aperatures in their free ends.
Figure 8:
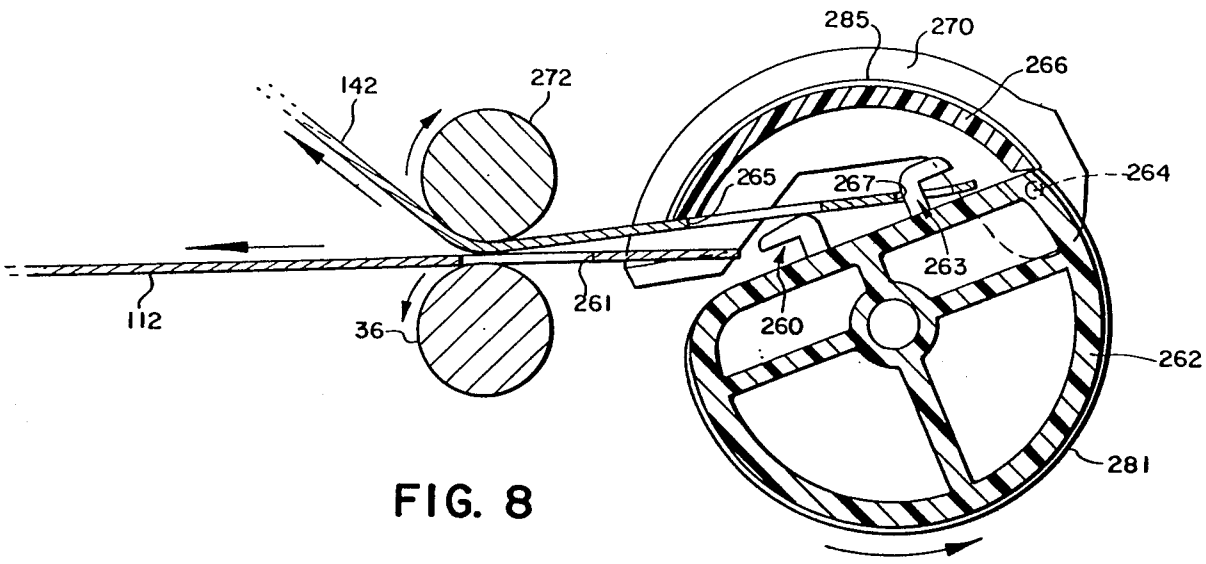
FIG. 8 is an enlarged side elevational view, partly in section, depicting the relationship between the take-up roller and the pair of leaders at the time of detachment of one of the leaders from the take-up roller.

In the operation of the apparatus 10, a closed kit 42 is positioned within the apparatus 10 such that the drive member 180 engages the drive flanges 184 and 186 of the sheet material roller 100, the arm 46 of the rack 48 extends into the passageway 64 and the cams 50 enter the apertures 138 in the side walls 78 and 80 of the second section 56 of the kit 42 thereby moving the latching members 74 and 76 into an inoperative position. Also the leader 114 of the sheet material 112 is detached from the end wall 82 of the kit 42 and trailed across the roller 36 and finally attached to a first post 260, which extends upwardly from a section 262 of the take-up roller 40, via a keyhole shaped aperture 261. As best shown in FIG. 7, the section 262 is pivotally connected by hinge pins 264 to a second section 266 of the take-up roller 40. The second section 266 includes flanges 268 and 270 at opposite ends thereof for guiding the sheet material 112 and the film 142 onto laterally spaced shoulders 281 and 283 on the first section 262 and shoulders 285 and 287 on the second section of the take-up spool 40 during clockwise rotation of the latter. Next, the film cassette 140 containing the exposed roll of film 142 is loaded into the apparatus 10 such that the drive member 188 drivingly engages the end of the film spool 144 and the members 152 and 154 support the film cassette 140, as shown in FIG. 2. The leader 146 of the film 142 is then attached to the first post 260 and to a second post 263 such that the emulsion side of the film 142 faces the gel coated surface of the sheet material 112. The leader 146 is provided with a first aperture 265, having a configuration substantially identical to that of aperture 261, which is adapted to receive the first post 260. The film leader 146 is also provided with a second aperture 267 which is adapted to receive the second post 263. The minimum spacing S between a curved surface 269 of the first post 260 and a vertical portion 271 of the second post 263 is less than the corresponding spacing between the right-hand edges of first and second apertures 265 and 267 in the film leader thereby assuring that rotative force of the take-up roller or spool 40 is transferred to the leaders 114 and 146 via the engagement of the curved surface 269 with the right-hand ends of the apertures 261 and 265. Further, the first section 262 of the spool 40 is provided with a raised rectangular portion 273 which, when taken in conjunction with the cut-out portion 275 in each of the leaders 114 and 146, assists the user in the correct orientation of the leaders with respect to the spool 40. The second section 266 is then pivoted into superpostion with the first section 262. The loading door is then closed thereby bringing a roller 272 into superpositon with the roller 36. The journals 274 of the roller 272 are suitably supported in the ends of a pair of supporting arms 278 and 280 which extend downwardly from the loading door 14. The closing of the loading door 14 also moves (1) the teeth of the sector gear 240 into mesh with the gear teeth 246, and (2) a latch pin 282, which extends downwardly from the loading door 14, into the gearbox 28 via an opening 284 therein. With the housing door 14 closed, thereby rendering the apparatus lighttight, the elements shown in FIG. 3 are positioned as shown. The gearbox 28 is recessed at 243 to accommodate the shaft 242, and the door 14 is cut away at 245 to provide clearance for the shaft of the crank 198 when the door 14 is in the closed position.

Processing of the film 142 is initiated by the operator turning the lever 238 from a non-processing position shown in FIG. 3 to a processing position shown in FIG. 2. Initial rotation of the lever 238 into the processing position is transferred to the rack 48 via the teeth of the sector gear 240 thereby moving the rack 48 rearwardly, i.e., to the left as viewed in FIGS. 2 and 3. This movement of the rack 48 causes several events to occur. Specifically, as the rack 48 moves to the left, the cam slots 222 and 232 therein cause the bell crank 178 and the link 200 to rotate in a counterclockwise direction about their respective pivots 202 and 228, respectively. Such rotation of the bell crank 178 results in its U-shaped portion 224 moving downwardly out of engagement with the gear 172 thereby enabling it to return, under its spring bias, to its normal position in engagement with the gear 158, as shown in FIG. 5. Simultaneously therewith, the latching surface 206 of the arm 204 of the bell crank 178 has rotated through an opening 285 in the gearbox 28 into latching relation with the lip 208 thereby precluding accidental opening of the loading door 14 at this time in the processing cycle. The rotation of the link 200 functions to remoe a pawl 286, which is an integral part of the link 200, from engagement with the teeth of the gear 172 thereby permitting subsequent counterclockwise rotation thereof. The pawl 286 of the link 200 is held out of engagement with the gear 172 by the latch pin 282 which enters a recess 290 in the top of the link 200. The latch pin 282 will continue to maintain the pawl 286 out of engagement with the gear 172 until the loading door 14 is opened. Clockwise rotation of the gear 172 is prevented by a second pawl 288 which extends downwardly from the top wall of the gearbox 28 into engagement with the teeth of the gear 172. The rearward movement of the rack 48 also moves the cam 196 in a directon which enables the gear 168 to move, under its spring bias, along the shaft 192 to a position wherein it is no longer in engagement with the gear 166. Further, rearward movement of the rack 48 is effective to cause its arm 46 to move the first section 54 of the kit 42 away from the second section 56 (the second section 56 being maintained in position by the cams 50) thereby opening the kit prior to the rupturing mechanism 252 being rotated toward the container 124.

After the lever 238 has been rotated through an angle of approximately twenty-three degrees, the right side (as viewed in FIG. 2) of the aperture 248 in the sector gear 240 moves into engagement with the pin 250 thereby causing any continued rotation of the lever 238 toward the processing position to not only continue the rearward movement of the rack 48 but also to commence the rotation of the rupturing mechanism 252 toward the position shown in FIG. 2. Because of the aforedescribed lost motion connection between the lever 238 and the pin 250, the roller 258 moves into the kit 42 as its top wall 58 moves out of interference therewith. The roller 258 engages the container 124 and increases the pressure on the processing liquid 130 therein to a point where the end 126 of the container ruptures. Continued clockwise rotation of the roller 258 about its pivot pin 242 causes the roller 258 to force the processing liquid from the container 124 into the dispenser 116.

Once the lever 238 is in the processing position, as shown in FIG. 2, the operator rotates the crank 198 in the direction of the arrow 292 thereby providing a power input to the first power path, i.e., the gear 158, to rotate the take-up roller 40 in a clockwise direction, as viewed in FIG. 2. Such rotation of the take-up roller 40 is effective to withdraw the sheet material 12 from its roller 100, move it past the nozzle 118 of the dispenser 116, whereat it is resiliently urged into engagement with the nozzle 118 by the plate 32 such that a uniform coating of the processing liquid 130 may be applied thereto, and then toward the bite of the rollers 36 and 272 where it will be married with the film 142 (which is also being withdrawn from its cassette 140). The rollers 36 and 272 press the gel coated surface of the sheet material 112 into engagement with the emulsion side of the exposed film 142 so as to form a laminate comprised of a layer of processing liquid 130 sandwiched between the sheet material 112 and the exposed film 142. The resulting laminate is then wound upon the take-up roller 40. When the sheet material 112 and/or the film 142 have been completely uncoiled from their respective supports, but not detached therefrom, the resultant increase in tension in the laminate is automatically fed back to the crank 198 thereby signaling the operator to stop rotating the crank 198. To prevent any damage to the apparatus 10 or the laminate, a clutch may be coupled between the shaft 174 and the crank 198 so that further rotation of the crank 198 by the operator is not transferred to the shaft 174. The laminate is then allowed to remain upon the take-up roller 40 for a period of time, e.g., one minute, which is sufficient for visible images to be formed in the laminate, preferably in the film 142.

After the formation of the visible images within the laminate has been substantially completed, the lever 238 is rotated in a counterclockwise direction, as viewed in FIG. 2, toward the non-processing position. Such rotation is effective to drive the rack 48 forwardly toward the take-up roller 40 while simultaneously moving the first section 54 of the kit 42 into closing relation with the second section 56. Although initial rotation of the lever 238 is not transferred to the rupturing mechanism 252 because of the aforedescribed lost motion connection, the mechanism 252 is given a head start due to an edge 294 of the top wall 58 of the first section 54 engaging the undersurface 296 of the mechanism and pivoting it upwardly until such time that the left side of the aperture 248 engages the pin 250 so as to complete the movement of the rupturing mechanism 252 out of the kit 42 before it closes. Further, it should be noted that an edge 298 of the bottom wall 62 of the first section 54 is beveled such that it may cooperate with a radius 300 on the spring biased plate 32 so as to urge the plate 32 downwardly thereby enabling the edge 298 to pass to a point where the bottom wall 62 seals the nozzle 118. Movement of the rack 48 from its rearward or processing position, as shown in FIG. 2, to its forward position, as shown in FIG. 3, also effects a clockwise rotation of the bell crank 178 due to the cam slot 222 and cam follower 218 relationship. This rotation pivots the end 206 of the arm 204 out of latching relation with the lip 208. It also results in the U-shaped section 224 moving upwardly into contact with the gear 172 such that its cam surface 226 will move the gear 172 out of engagement with the gear 158 and into engagement with the gear 612. Further, the cam 196 on the rack moves the gear 168 back into engagement with the gear 166. However, the movement of the rack 48 into the second position does not affect the position of the link 200 since the pin 282 maintains it in a position wherein the pawl 286 is held, against the bias of the free end 306 of a spring, out of engagement with the teeth of the gear 172.

With the lever 238 in the horizontal position, the operator may then rotate the crank 198 in the same direction as before, i.e., in the direction of the arrow 292. The power input is directed to the second power path via the gear 172 thereby rotating the sheet material roller 100 and the film spool 144 in a clockwise manner, as viewed in FIG. 5. The clockwise rotation of the roller 100 and film spool 144 is effective to withdraw or unwind the laminate from the take-up roller 40. As the laminate emerges from the left side (as viewed in FIG. 2) of the superposed rollers 36 and 272, the film 142 is stripped from the sheet material 112 and rewound upon the film spool 144 as the sheet material 112 is simultaneously rewound upon its roller 100. As is more fully described in U.S. Pat. No. 4,309,100, in a preferred type of film the photosensitive or emulsion layer of the film 142 exhibits a greater adhesion to the sheet material 112 than to the next adjacent layer(s) of the film whereby stripping the sheet material 112 from the film 142 serves to remove the emulsion layer thus increasing visual acuity and brightness of the resultant, positive transparency and enhancing its stability by virtue of the removal of residual processing reagent in the emulsion. For further details of the film, reference may also be had to U.S. Pat. No. 3,682,637.

In an alternative embodiment, the visible images would be formed in the sheet material. Accordingly, the film would be comprised of a photosensitive layer through which the exposure would be made, vis-a-vis the film 142, and a base which may or may not be transparent. Also, the sheet material would be comprised of a transparent base and an image receiving layer. Subsequent to the exposure of the film, the side of the sheet material containing the image receiving layer would be coated with the processing liquid and brought into engagement or superposition with the side of the film through which the exposure has been made. This may involve reversing the orientation of the film cassette from the position shown in FIG. 2 so as to place the image receiving layer in contact with the emulsion side of the film. After the spreader sheet has been stripped from the film and rewound upon its spool, the spool would be removed and the individual scenes in the sheet material would be cut and mounted for subsequent viewing.

Withdrawing the laminate from the take-up roller 40 causes the latter to rotate in a counterclockwise direction, as viewed in FIG. 2. As the last wrap of the laminate is wound from the take-up roller 40, the portion of the laminate extending between the bite of the rollers 36 and 272 and the take-up roller 40 pivots the second section 266 about the hinge 264. Also, at this time, the first post 260 moves out of the apertures 261 and 265 thereby releasing the sheet material leader 114 so that it may be fully rewound into the processing kit 42. More specifically, the first post 260 includes a section 277 which extends in cantilever fashion and is tapered in the direction of rotation of the spool 40 during unwinding of the laminate. Thus, as the spool 40 rotates in a counterclockwise direction, the free end of the tapered section 277 also rotates in a counter-clockwise direction relative to the last portion or end of the laminate such that it progressively enters and cams the longitudinally extending portions of the apertures 261 and 265 apart. However, the film leader 146 remains attached to the spool 40 due to the second post 271-aperture 267 connection. Rotation of the crank 198 is continued after release of the leader 114 until it has been completely rewound within the processing kit 42 while the increase in tension in the film activates the clutch 190 thereby preventing any further rotation of the film spool 144. The loading door 14 may then be opened thereby releasing the link 200 for movement back into the position shown in FIG. 3. The kit 42 may now be removed and safely discarded since all materials used in the processing of the film 142 are safely enclosed within the closed kit. Also, at this time, the film leader 146 may be detached from the second post 271, the film cassette 140 removed from the apparatus, and the processed film removed therefrom for subsequent cutting and mounting of the individual scenes.

Figure 2A:
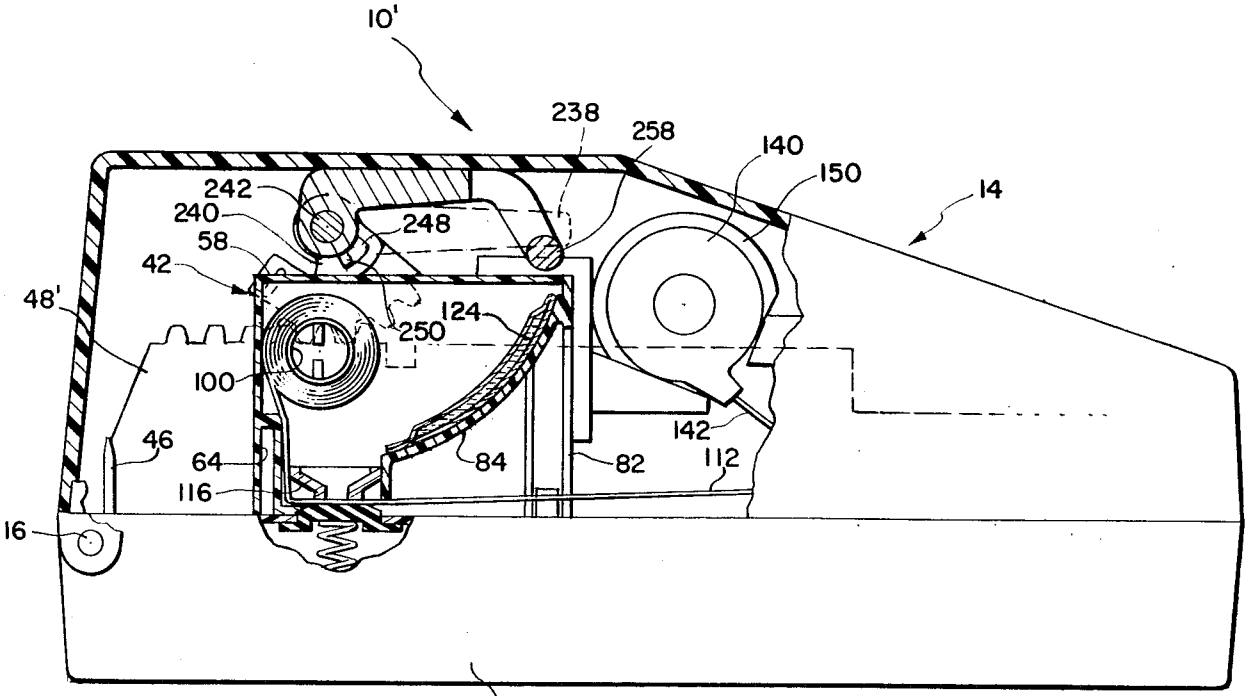
FIG. 2A is a view similar to FIG. 2 showing an improperly loaded processing kit in an apparatus of the prior art.

As is well known in the art, it is important to guide the operator of an apparatus such as that disclosed herein in such a way that the sequence of events takes place in a predetermined order. For example, the processor 10 and its operation, as described up to this point, is substantially identical to that disclosed in the '770 patent. However, the processor of the '770 patent is susceptible to being damaged during the aforedescribed processing cycle if its rack 48' is in the second or processing position at the time that the loading door is closed, a condition shown in FIG. 2A. FIG. 2A depicts the condition wherein the rack 48' is initially in the processing position, such as may have occurred during assembly of the processor 10', or may have occurred by being manipulated by a user, at the time that a processing kit 42 and the film cassette 140 are loaded into the processor 10'. When the operator closes the loading door 14, the lip 208 may be cammed over and under the latching surface 206 thereby latching the door 14 in its closed position. Note, as previously mentioned, the latching surface 206 will be located in the path of movement of the lip 208 because the rack 48' is in the second position. The operator's next step is to move the lever 238 from the horizontal position shown in FIG. 2A to the position shown in FIG. 2. Ordinarily, this step would have caused the arm 46 of the rack 48' to open the kit 42 prior to moving the rupturing roller 258 into the kit. However, as can be seen in FIG. 2A, the arm 46 and the rack 48' are in their rearmost positions before the lever 238 is turned. Thus, the kit cannot be opened, nor can the container 124 of processing liquid be ruptured. However, often the operator does not realize that something is wrong and continues to apply pressure to the lever 238 until its connection with the sector gear 240 and thus the processing fluid container rupturing mechanism 252 is broken. Again, not realizing what has happened, the operator continues on to the next step in the processing cycle, i.e., rotation of the crank 198. Such rotation will be effective to wind the exposed film 142 and the sheet material 112 upon the take-up roller 40, sans any processing liquid being located on the sheet material. After waiting a predetermined period of time for images to form in the film, the operator returns the lever 238 to its original position, which would have ordinarily resulted on the rack 48' moving forwardly into its first position thus (1) unlatching the loading door 14, and (2) redirecting the drive of the crank 198 from the roller 40 to the drive members 180 and 188 so as to rewind the sheet material 112 and the film 142 onto their spools upon subsequent rotation of the crank 198. However, since the lever's connection with the sector gear 240 has been broken, the rack 48' remains in the second position, the loading door 14 remains latched in its closed position, and the drive of the crank 198 is still connected to the take-up roller 140. Next, the operator attempts to rotate the crank 198 so as to drive the film and sheet material drives 180 and 188, respectively. This effort is futile because the crank's output is still connected to the take-up roller 40. Finally, the operator is required to force the loading door 14 out of its latched position, thereby possibly causing more damage to the processor 10' and also fogging the exposed but not developed film 142.

The above problem has been solved by providing the processor 10 with means for preventing movement of the loading door into its closed position when the rack 40 is already in its second position. Thus, the preventing means prohibits latching of the loading door 14 in its closed position when the rack 48 is in the wrong position. Specifically, the preventing means includes a first member 310 which extends integrally from the rack 48 and has therein a recess 312, and a second member 314, in the form of a pin, which extends integrally inwardly from an interior surface of the side wall 234 of the loading door 14. The spacial relationship between the first and second members 310 and 314 is such that if the rack 48 is in the second position, as shown in FIG. 2, at the time the operator moves the loading door 14 toward its closed position, the second member 314 will strike the top of the first member 310 thereby preventing further movement of the loading door into the closed position. Further, the closing movement of the loading door 14 is arrested at a position relative to the main housing 12 that no latching of the loading door takes place. Still further, the relative position of the loading door to the main housing 12 makes it readily apparent to the operator that something is wrong. Once the operator recognizes what the problem is, i.e., the rack 48 is in the wrong position, he may then move the processing kit 42 to a position wherein the rack 48 may be manually moved into its first position. The processing kit 42 is then repositioned such that the arm 46 of the rack 48 extends into the passageway 64 in the first section 54 of the kit 42 and the loading door 14 is moved into its fully closed position. Now, movement of the lever 238 in a clockwise manner, as viewed in FIG. 3, will result in the rack 48 moving into its second position as (1) the arm 46 opens the kit prior to movement of the roller 258 into the kit 42, (2) the latching surface 206 moves into locking engagement with the lip 208 on the loading door 14, and (3) the recess 312 receives the pin 314 so as to also latch the loading door 14 in its closed position (as shown in FIG. 2). In a preferred embodiment of the invention the latching arrangement between the pin 314 and the recess 312 performs the main latching function of the loading door, the latching surface 206 and lip 208 functioning as a secondary latching arrangement. Alternatively the latter latching arrangement may be omitted entirely.

Since certain changes may be made in the above described apparatus without departing from the scope of the invention herein involved, it is intended that all matter contained in the above description or shown in the accompanying drawings shall be interpreted as illustrative and not in a limiting sense.

What is claimed is:

1. A manually operable film processor for processing individual rolls of photographically exposed film, said film processor comprising:

a housing for defining a lighttight chamber, said housing including a loading door movable between open and closed positions;

means for locating a film processing kit within said housing, the kit including a strip of flexible sheet material, a rupturable container having therein a supply of processing liquid, and a processing liquid dispenser which is adapted to apply a coating of processing liquid to one side of the sheet material as it is being withdrawn from the kit;

means for supporting a film cassette containing therein a roll of exposed film;

means mounted within said housing for receiving leading ends of the exposed film and the flexible sheet material, said receiving means being adapted to be driven in a direction so as to withdraw the film and sheet material from the cassette and the kit, respectively, and wind them in superposition upon said receiving means;

rupturing means mounted for movement into the kit and into rupturable engagement with the container of processing liquid to thereby enable the processing liquid to flow to the dispenser and thence onto the sheet material prior to it being superposed with the film;

means movable from a first position to a second position for opening the kit;

manually operable means drivingly coupled to said movable means and to said rupturing means for driving said operable means into said second position thereby opening the kit and for subsequently driving said rupturing means into engagement with the container of processing liquid; and means for preventing movement of said loading door into said closed position when said movable means is in said second position.

2. A film processor as defined in claim 1 wherein said preventing means includes a first member associated with said movable means and a second member associated with said loading door, said first and second members being located in interference with each other when said movable means is in said second position and said loading door is moved toward said closed position.

3. A film processor as defined in claim 2 wherein said first member is an extension of said movable means and said second member is an integral portion of said loading door.

4. A film processor as defined in claim 3 wherein said first member is constructed to receive said second member so as to lock said loading door in said closed position when said movable means is driven into said second position subsequent to said loading door being moved into said closed position.

5. A manually operable processor for processing individual rolls of photographically exposed film, said film processor comprising:

a housing for defining a lighttight chamber, said housing including a loading door movable between open and closed positions;

means for locating a film processing kit within said housing, the kit including a strip of flexible sheet material, a rupturable container having therein a supply of processing liquid, and a processing liquid dispenser which is adapted to apply a coating of processing liquid to one side of the sheet material as it is being withdrawn from the kit;

means for supporting a film cassette containing therein a roll of exposed film;

means mounted within said housing for receiving leading ends of the exposed film and the flexible sheet material, said receiving means being adapted to be driven in a direction so as to withdraw the film and sheet material from the cassette and the kit, respectively, and wind them in superposition upon said receiving means;

rupturing means mounted for movement into the kit and into rupturable engagement with the container of processing liquid to thereby enable the processing liquid to flow to the dispenser and thence onto the sheet material prior to it being superposed with the film;

means movable from a first position to a second position for latching said loading door in said closed position;

manually operable means drivingly coupled to said movable means and to said rupturing means for driving said movable means into said second position and said rupturing means into engagement with the container of processing liquid; and means for preventing latching of said loading door in said closed position when said movable means is in said second position prior to movement of said loading door toward said closed position.

6. A film processor as defined in claim 1 wherein said preventing means includes a first member associated with said movable means and a second member associated with said loading door, said first and second members being located in interference with each other when said movable means is in said second position and said loading door is moved toward said closed position.

7. A film processor as defined in claim 6 wherein said first member is an extension of said movable means and said second member is an integral portion of said loading door.

8. A film processor as defined in claim 7 wherein said first member is constructed to receive said second member so as to lock said loading door in said closed position when said movable means is driven into said second position subsequent to said loading door being moved into said closed position.

9. A compact, portable, manually actuatable film processor comprising:

a housing for defining a lighttight chamber, said housing including a door movable between open and closed positions for providing access to said chamber;

means for locating a film processing kit within said housing, the kit including a rupturable container of processing liquid and means for transferring the liquid to the surface of an exposed length of film, means for supporting a film cassette containing a length of exposed film;

means movable between first and second positions for opening the processing kit and for latching said door in said closed position;

means for rupturing the container of processing liquid;

means for driving said movable means into said second position and said rupturing means into rupturable engagement with the container of processing liquid; and means for preventing latching of said door in said closed position after said movable means has been moved into said second position.

10. A film processor as defined in claim 9 wherein said preventing means includes a protuberance extending inwardly from a side wall of said cover and means defining a slot in said movable means, said slot being adapted to receive said pin only when said door is in said closed position prior to driving said movable means toward said second position.

* * * * *